US007164072B2

(12) United States Patent
Park

(10) Patent No.: US 7,164,072 B2
(45) Date of Patent: Jan. 16, 2007

(54) BRACE BAR FOR SOUND BOARD OF GUITAR

(75) Inventor: In Jae Park, Yangju-si (KR)

(73) Assignee: Sungeum Music Co. Ltd. (KR)

( * ) Notice: Subject to any disclaimer, the term of this patent is extended or adjusted under 35 U.S.C. 154(b) by 64 days.

(21) Appl. No.: 10/721,113

(22) Filed: Nov. 25, 2003

(65) Prior Publication Data

US 2005/0109188 A1 May 26, 2005

(51) Int. Cl.
*G10D 3/00* (2006.01)

(52) U.S. Cl. ..... 84/294

(58) Field of Classification Search ..... 84/291, 84/294, 192, 189, 190
See application file for complete search history.

(56) References Cited

U.S. PATENT DOCUMENTS

| | | | | |
|---|---|---|---|---|
| 3,427,915 A | | 2/1969 | Mooney | |
| 3,685,385 A | * | 8/1972 | Rendell | 84/267 |
| 4,056,034 A | | 11/1977 | Kaman | |
| 4,079,654 A | | 3/1978 | Kasha | |
| 5,406,874 A | * | 4/1995 | Witchel | 84/291 |
| 5,952,592 A | * | 9/1999 | Teel | 84/267 |
| 6,294,718 B1 | | 9/2001 | Saunders, Jr. et al. | |
| 6,627,803 B1 | * | 9/2003 | Stephens | 84/291 |
| 2003/0154843 A1 | | 8/2003 | McPherson | |

FOREIGN PATENT DOCUMENTS

| | | |
|---|---|---|
| DE | 1275341 | 8/1968 |
| GB | 2408377 | 2/2006 |

* cited by examiner

*Primary Examiner*—Kimberly Lockett
(74) *Attorney, Agent, or Firm*—Robert W Becker & Associates; Robert W Becker

(57) ABSTRACT

Disclosed is a brace bar attached to an inner surface of a sound board of a guitar to prevent the sound board from being distorted, which has a modified shape to improve the flexibility of the sound board while maintaining the strength of the sound board, thus improving the resonance of the sound board and reducing a weight of the sound board. The brace bar includes a narrow portion having a cross-section with a profile of which at least one side extends vertically upward to a position of a predetermined height, thus forming a lower base part, and is bent inward at the position toward a center of the brace bar, and, thereafter, extends upward while being inclined at a predetermined inclination angle to form a tapered upper part.

3 Claims, 6 Drawing Sheets

BRACE BAR FOR SOUND BOARD OF GUITAR

BACKGROUND OF THE INVENTION

1. Field of the Invention

The present invention pertains, in general, to brace bars attached to an inner surface of a sound board of a guitar to prevent the sound board from being deformed and, more particularly, to a brace bar attached to an inner surface of a sound board of a guitar, which has a modified shape to improve the flexibility of the sound board while maintaining the strength of the sound board, thus improving the resonance of the sound board and reducing a weight of the sound board.

2. Description of the Related Art

Generally, as shown in FIGS. 1 and 2, a guitar includes a body 1 having a sound board 1*a* attached to an upper part thereof, a block 2 made of wood attached to an inner surface of the body 1 and having a groove 2*a* to receive a neck 3, the neck 3 being connected to the block 2 in such a way that a lug 3*a* of a heel 3*b* of the neck 3 is inserted into the groove 2*a* of the block 2, a fingerboard 4 attached to an upper surface of the neck 3, a bridge 5 attached to an upper surface of the sound board 1*a* of the body 1, a brace bar 6 attached to a lower surface of the sound board 1*a*, a head 7 integrated with an end of the neck 3 which is not connected to the body 1, strings 8 connected between the bridge 5 and the head 7, and a fingerboard adjusting rod 9 longitudinally installed on an upper, central surface of the neck 3 to adjust a state of an even surface of the fingerboard 4.

The guitar is provided with a resonant sound board 1*a* to resonate for a relatively long time and to make peculiar sounds.

To prevent the sound board 1*a* from being distorted while it is used for a long term, various kinds of brace bars 16, 16', 16*a*, 16*b*, 16*a*', 16*b*' are attached to an inner surface of the sound board 1*a* as shown in FIGS. 3 and 4. The stronger the brace bar attached to the sound board 1*a* is, the longer a life span of the guitar is. On the other hand, the flexible brace bar contributes to improving resonance of the sound board 1*a* to allow the guitar to resonate for a relatively long time.

If the brace bar is not strong, the sound bar 1*a* bends over time. Thus, the life span of the guitar is shortened because the sound bar 1*a* does not fulfill its own function. On the other hand, if the brace bar is too strong, the resonance of the sound board 1*a* is poor even though the sound board 1*a* is not distorted, thus the guitar makes a poor sound for a short time.

Accordingly, it is preferable that the brace bar has flexibility as well as strength. Furthermore, a shape and the number of the brace bars, and an attachment structure of the brace bar to the sound board 1*a*, are important factors affecting the performance and durability of the guitar.

Referring to FIGS. 3 and 4, there are illustrated a plurality of brace bars attached to an inner surface of a sound board of a conventional guitar. At this time, shapes and the number of the brace bars, and the attachment structure of the brace bars to the sound board of FIG. 3, are similar to those of FIG. 4. In other words, two pairs of first and second main brace bars 16, 16' are attached to the inner surface of the sound board in the shape of an 'X', and first and second auxiliary brace bars 16*a*, 16*b*, 16*a*', 16*b*' are attached to the inner surface of the sound board as a way to be positioned around the main brace bars. As described above, FIG. 3 is similar to FIG. 4 in views of the shapes and the number of the brace bars, and the attachment structure of the brace bars to the sound board. However, FIG. 3 is different from FIG. 4 in terms of several facts. In detail, the first main and first auxiliary brace bars 16, 16*a* of FIG. 3 have recessed parts formed on middle portions (a) thereof. At this time, each of the recessed parts forms a bow with its center being bent downward. On the other hand, the second main and second auxiliary brace bars 16', 16*a*' of FIG. 4 have not the recessed parts, and each has a cross-section with a profile of which a side extends vertically upward to a position of a predetermined height, thus forming a lower base part, and extends upward while being bent toward the center of each brace bar to form a parabolic upper part (b), as shown in FIG. 5.

That is to say, in FIG. 3, the first main and first auxiliary brace bars 16, 16*a* have longer heights than widths to allow the sound board 1*a* of FIG. 3 to have the strength, and have the bow-shaped recessed parts formed on the middle portions (a) thereof to allow the sound board of FIG. 3 to have increased flexibility. Furthermore, the second main and second auxiliary brace bars 16', 16*a*' of FIG. 4 each has the cross-section with the profile of which the side extends vertically upward to the position of the predetermined height, thus forming the lower base part, and extends upward while being curved toward the center of each brace bar to form the parabolic upper part (b), as shown in FIG. 5, thereby their sectional areas are reduced to allow the sound board 1*a* of FIG. 4 to have the flexibility to improve the resonance of the sound board 1*a* and to make a middle- and a low-pitched sound for a relatively long time.

Therefore, the present invention provides a brace bar attached to an inner surface of a sound board of a guitar, which has a modified shape to improve the flexibility of the sound board while maintaining the strength of the sound board.

SUMMARY OF THE INVENTION

Accordingly, the present invention has been made keeping in mind the above problems occurring in the prior art, and an aspect of the present invention is to provide a brace bar attached to an inner surface of a sound board of a guitar, which has a modified shape to improve flexibility of the sound board while maintaining the strength of the sound board, thus improving resonance of the sound board and reducing a weight of the brace bar to reducing a weight of the guitar to provide ease of use to a guitar player.

Additional aspects and/or advantages of the invention will be set forth in part in the description which follows and, in part, will be obvious from the description, or may be learned by practice of the invention.

The above and/or other aspects are achieved by providing a brace bar attached to an inner surface of a sound board forming a body of a guitar to reinforce the sound bar, including a narrow portion having a cross-section with a profile of which a side extends vertically upward to a position of a predetermined height, thus forming a lower base part, and is bent inward at said position toward a center of the brace bar, and, thereafter, extends upward while being inclined at a predetermined inclination angle to form a tapered upper part.

BRIEF DESCRIPTION OF THE DRAWINGS

This and other aspects and advantages of the invention will become apparent and more readily appreciated from the following description of the preferred embodiments, taken in conjunction with the accompanying drawing of which.

DETAILED DESCRIPTION OF THE PREFERRED EMBODIMENTS

Figure 6:
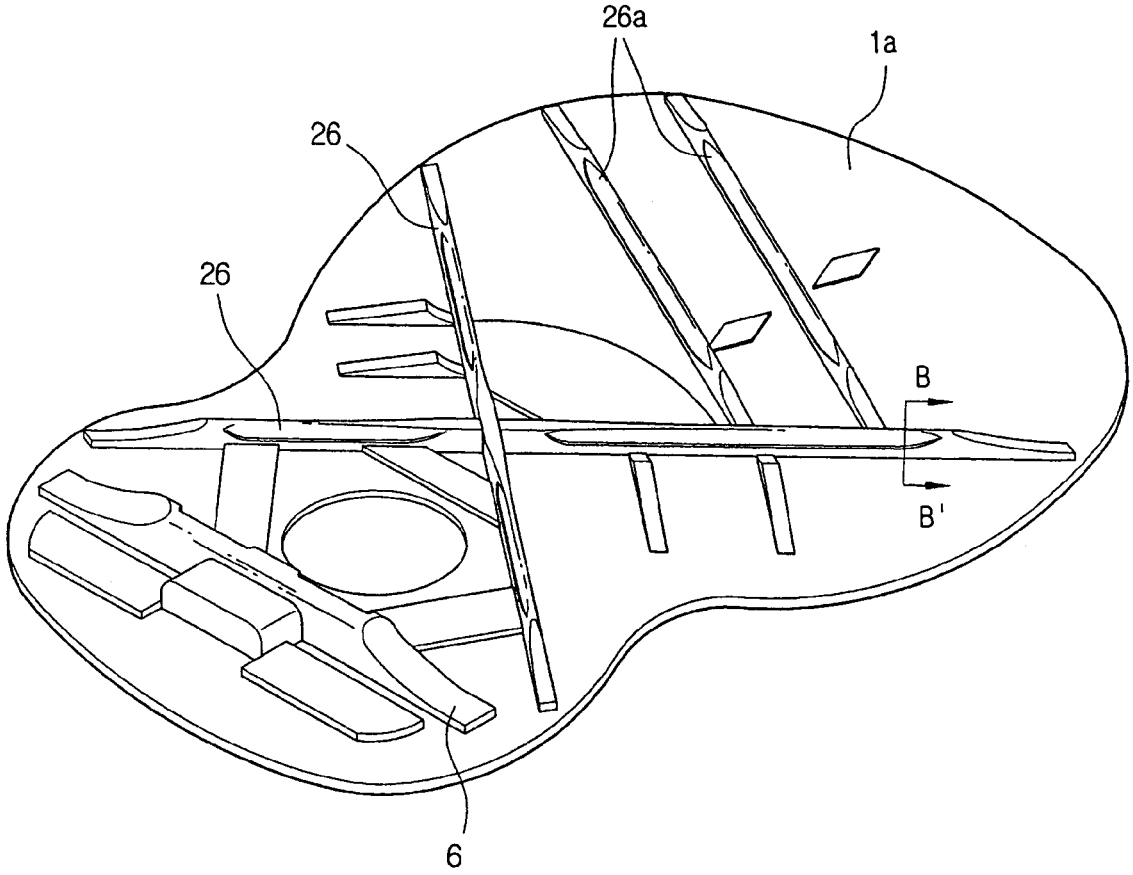
FIG. 6 is a perspective view of a brace bar attached to an inner surface of a sound board of a guitar according to the first embodiment of the present invention.
Figure 7:
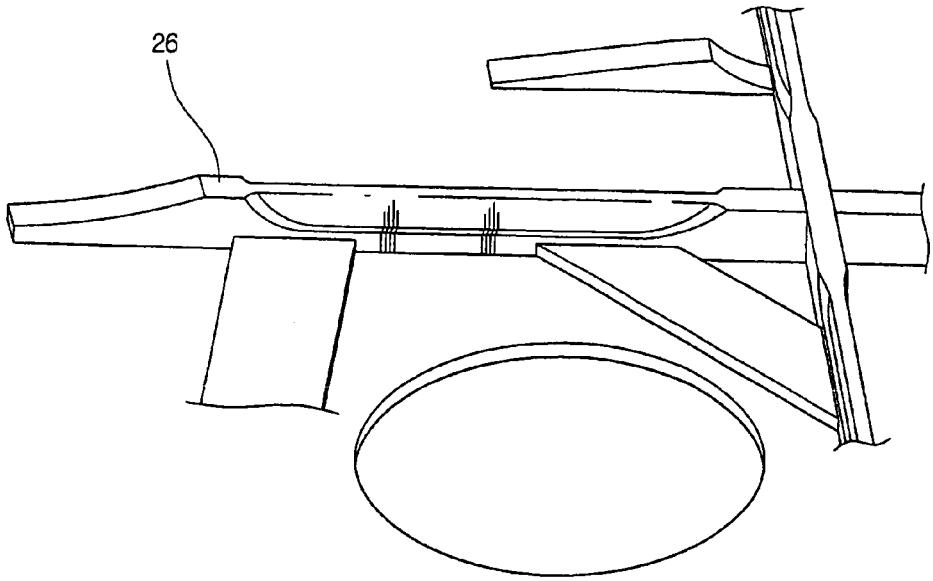
FIG. 7 is an enlarged perspective view of the brace bar of FIG. 6.
Figure 8:
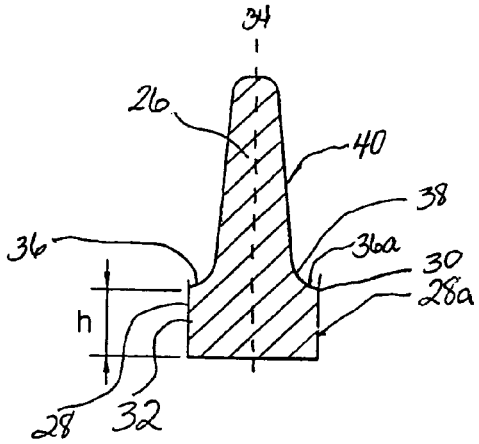
FIG. 8 is an enlarged sectional view of the brace bar taken in the direction of the arrows along the line B–B' of FIG. 6.
Figure 9:
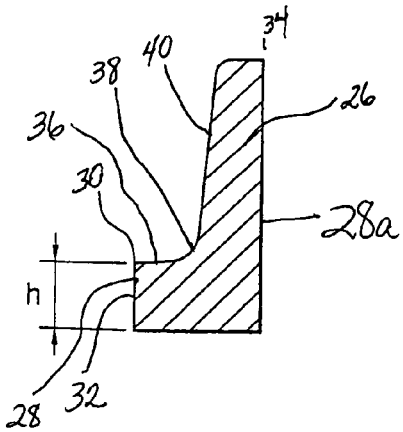
FIG. 9 is a sectional view of a brace bar according to the second embodiment of the present invention.

Reference will now be made in detail to the present preferred embodiments of the present invention, examples of which are illustrated in the accompanying drawings As shown in the drawings, FIG. 6 is a perspective view of a brace bar attached to an inner surface of a sound board of a guitar according to the first embodiment of the present invention, FIG. 7 is an enlarged perspective view of the brace bar of FIG. 6, FIG. 8 is an enlarged sectional view of the brace bar taken in the direction of the arrows along the line B–B' of FIG. 6, and FIG. 9 is a sectional view of a brace bar according to the second embodiment of the present invention.

With reference to FIGS. 6 and 7, brace bars 26, 26*a* according to the first embodiment of the present invention are attached to an inner surface of a sound board 1*a* of a guitar to reinforce the sound board 1*a*. In this regard, the brace bars 26, 26*a*, each include a narrow portion having a cross-section with a profile of which a side extends vertically upward to a position (p) of a predetermined height (h), thus forming a lower base part, and is bent inward at the position (p) toward a center of the brace bar, and, thereafter, extends upward while being inclined at a predetermined inclination angle to form a tapered upper part (c), as shown in FIG. 8.

Meanwhile, FIG. 8 illustrates the brace bars 26, 26*a* according to the first embodiment of the present invention. At this time, the brace bar 26 (26*a*) according to the first embodiment of the present invention has a cross-section with the profile that both sides 28, 28*a* extend vertically upward to the position 30 of the predetermined height, thus forming a lower base part 32, and are then bent inward at position 30 toward the center of the brace bar 34, thereby forming upper surfaces 36, 36*a* of the lower base part 32. The sides 28, 28*a* are then bent upward at the position 38 (best seen on FIG. 9), and, thereafter, extend upward while being inclined at the predetermined inclination angle to form the tapered upper part 40. On the other hand FIG. 9 illustrates the brace bar according to the second embodiment of the present invention. In this regard, the brace bars 26, 26*a* according to the second embodiment of the present invention have the cross-section that one side 28 extends vertically upward to the position 30 of the predetermined height, is bent inward at the position 30 toward the center 34 of the brace bar 26 forming an upper surface 36 of lower base part 32. The brace bars 26, 26*a* are bent upward at the position 38, and, thereafter extends upward while being inclined at the predetermined inclination angle, but the other side 28*a* extends vertically upward to a top of the brace bar. At this time, an irregular lateral line of the cross-section of the brace bar shown in FIG. 9 has the similar shape to both irregular lateral lines of the cross-section of the brace bar shown in FIG. 8. Hence, the brace bars according to the first and second embodiment of the present invention have nearly equal strength and flexibility.

Figure 1:
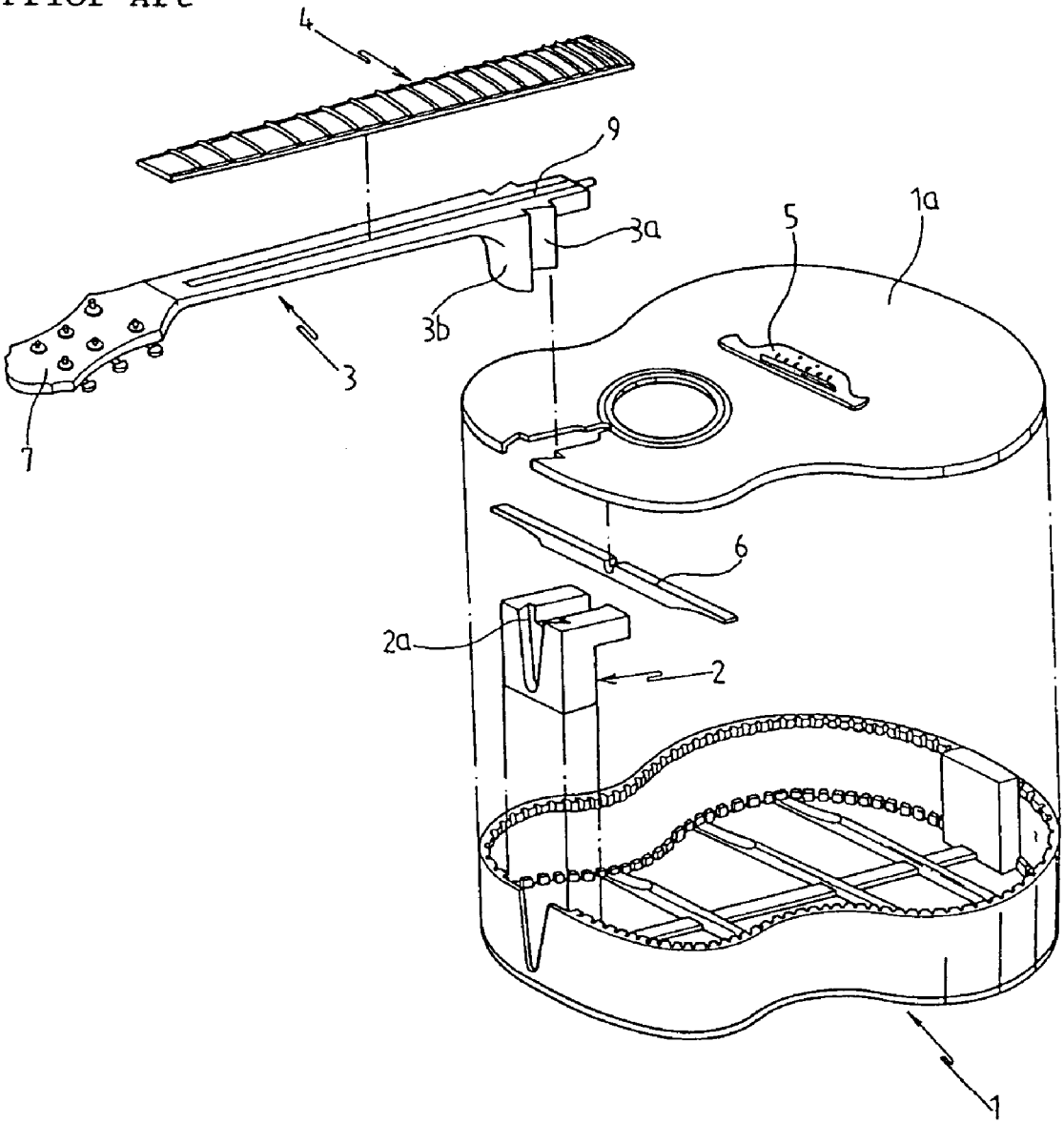
FIG. 1 Prior Art
FIG. 1 is an exploded perspective view of a conventional guitar.
Figure 2:
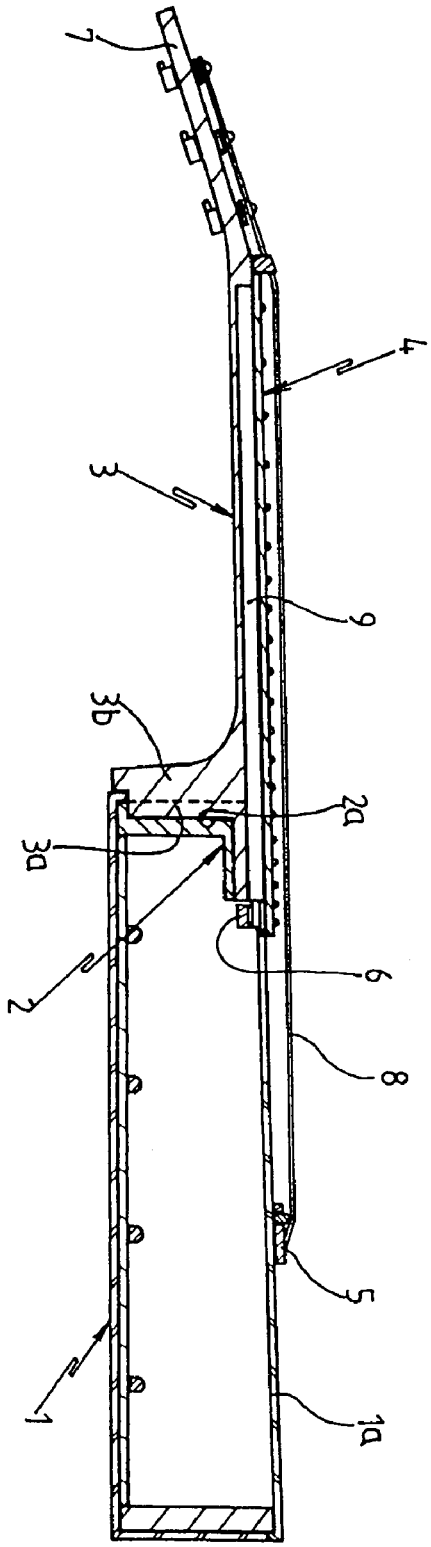
FIG. 2 Prior Art
FIG. 2 is a sectional view of the conventional guitar of FIG. 1.
Figure 3:
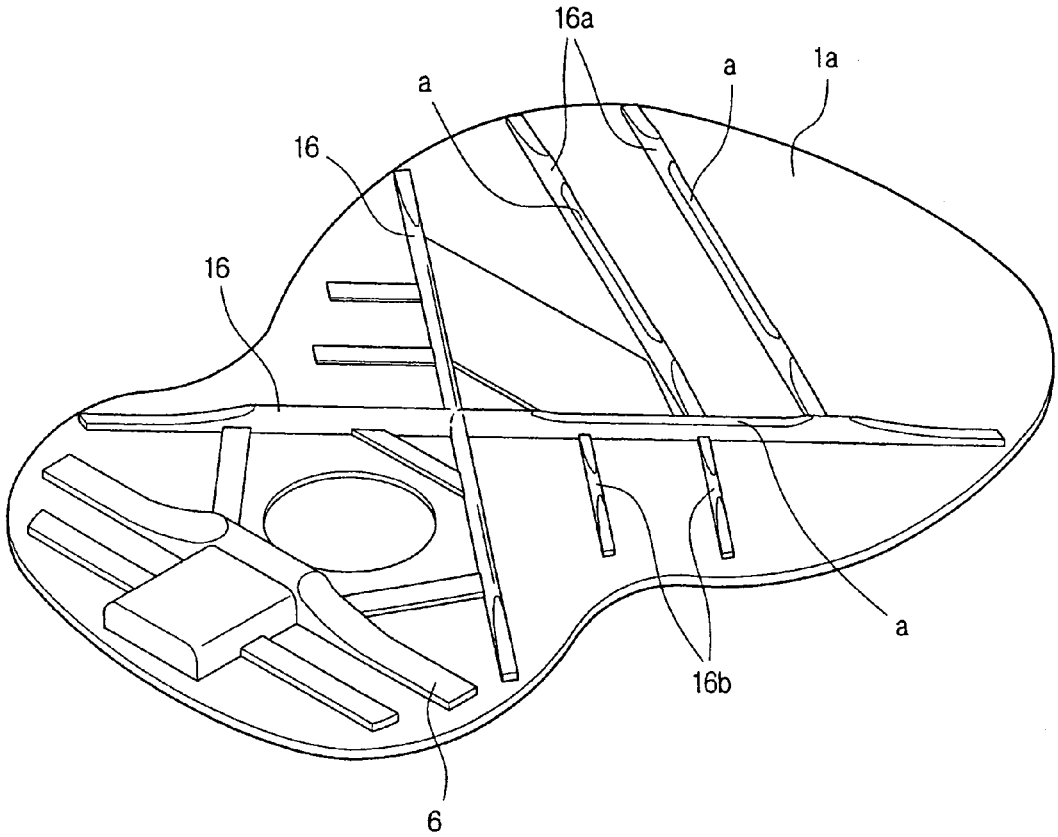
FIG. 3 Prior Art
FIG. 3 is a perspective view of a first brace bar attached to an inner surface of a sound board of the conventional guitar.
Figure 4:
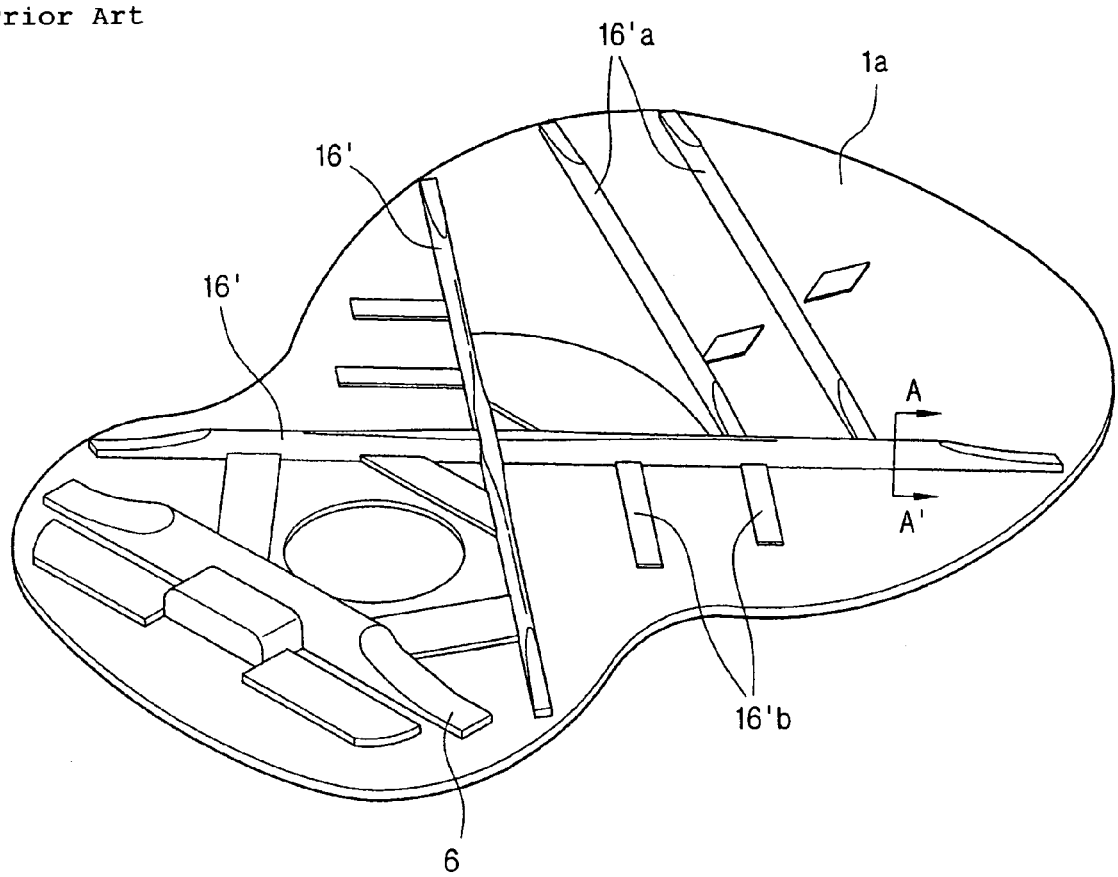
FIG. 4 Prior Art
FIG. 4 is a perspective view of a second brace bar attached to an inner surface of a sound board of the conventional guitar.
Figure 5:
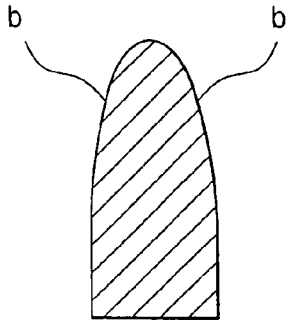
FIG. 5 Prior Art
FIG. 5 is a sectional view of the brace bar taken in the direction of the arrows along the line A–A' of FIG. 4.

The brace bar according to the present invention includes the narrow portion having the cross-section with the profile of which the side extends vertically upward to the position of the predetermined height, thus forming the lower base part, and is bent inward at the position toward the center of the brace bar, and, thereafter, extends upward while being inclined at the predetermined inclination angle to form the tapered upper part. Therefore, the brace bar of the present invention has a smaller sectional area than a conventional brace bar, as shown in FIG. 5, having a cross-section with a profile of which a side extends vertically upward to a position of a predetermined height, thus forming a lower base part, and extends upward while being bent toward the center of each brace bar to form a parabolic upper part. Additionally, the brace bar of the present invention is slightly higher than the conventional brace bar of FIG. 5, thereby simultaneously having the same strength as the conventional brace bar and the improved flexibility.

As described above, when the flexibility of the brace bar is improved, the resonance of the sound board is improved, thereby the guitar including the brace bar resonates for a relatively long time.

Further, the brace bar of the present invention has a smaller sectional area than the conventional brace bar of FIG. 5. Thus, the brace bar of the present invention is slightly lighter than the conventional brace bar, causing a reduction of a weight of the guitar to provide ease of use to a guitar player.

As apparent from the above description, the present invention provides a brace bar attached to an inner surface of a sound board of a guitar, which has a modified shape to improve flexibility of the sound board while maintaining the strength of the sound board, thus improving the resonance of the sound board to allow the guitar to resonate for a relatively long time and reducing a weight of the guitar to provide ease of use to a guitar player.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A brace bar attached to an inner surface of a sound board forming a body of a guitar to reinforce the sound board, comprising:

a narrow portion to improve the flexibility of the brace bar while maintaining a strength of the brace bar, thus improving the resonance of the body of the guitar, the narrow portion having a cross-section with a profile of which at least one side extends vertically upward to a position of a predetermined height, thus forming a lower base part, and is bent inward at said position toward a center of the brace bar thereby forming an upper surface of said lower base part, and, thereafter, extends upward while being inclined at a predetermined inclination angle to form a tapered upper part.

2. The brace bar as set forth in claim 1, wherein the narrow portion has a cross-section that both sides extend vertically upward to positions of the predetermined height, thus forming the lower base part, and are bent inward at the positions toward the center of the brace bar, and, thereafter, extend upward while being inclined at the predetermined inclination angle to form the tapered upper part.

3. The brace bar as set forth in claim 1, wherein the narrow portion has a cross-section that one side extends vertically upward to the position of the predetermined height, is bent inward at the position toward the center of the brace bar, and extends upward while being inclined at the predetermined inclination angle, but the other side extends vertically upward to a top of the brace bar.

* * * * *